US008570259B2

(12) United States Patent
Li et al.

(10) Patent No.: US 8,570,259 B2
(45) Date of Patent: Oct. 29, 2013

(54) SCAN METHOD FOR LIQUID CRYSTAL DISPLAY

(75) Inventors: Huan-Hsin Li, Toufen Township, Moaoli County (TW); Yao-Jen Hsieh, Pingtung (TW); Chih-Sung Wang, Jhubei (TW)

(73) Assignee: Au Optronics Corp., Hsinchu (TW)

( * ) Notice: Subject to any disclaimer, the term of this patent is extended or adjusted under 35 U.S.C. 154(b) by 2303 days.

(21) Appl. No.: 11/152,492

(22) Filed: Jun. 14, 2005

(65) Prior Publication Data

US 2006/0181499 A1 Aug. 17, 2006

(30) Foreign Application Priority Data

Feb. 17, 2005 (TW) ..... 94104605 A

(51) Int. Cl.
*G09G 3/36* (2006.01)

(52) U.S. Cl.
USPC ..... 345/87; 345/55; 345/204

(58) Field of Classification Search
USPC ..... 345/100, 103, 213
See application file for complete search history.

(56) References Cited

U.S. PATENT DOCUMENTS 5,675,353 A 10/1997 Tanaka et al.
5,767,832 A * 6/1998 Koyama et al. ..... 345/103
6,229,516 B1 * 5/2001 Kim et al. ..... 345/103
6,693,618 B2 * 2/2004 Son et al. ..... 345/99
7,098,900 B2 8/2006 Ozawa
7,133,015 B1 * 11/2006 Yoshida et al. ..... 345/99
7,221,352 B2 5/2007 Kodate
2003/0034946 A1 * 2/2003 Liang et al. ..... 345/89

FOREIGN PATENT DOCUMENTS

JP 2000235362 8/2000
TW 224768 1/1992
TW 541514 7/2003

OTHER PUBLICATIONS

English Abstract of JP2000235362.
English Abstract of TW224768.
English Abstract of TW541514.

* cited by examiner

*Primary Examiner* — William Boddie
*Assistant Examiner* — Leonid Shapiro
(74) *Attorney, Agent, or Firm* — McClure, Qualey & Rodack, LLP

(57) ABSTRACT

A scan method for use in a flat panel display comprising K groups of lines, comprising the following steps. First, K sequences $S_1$ to $S_K$ are provided. A scan order is then determined according to the K sequences $S_1$ to $S_K$. Thereafter, the K groups of lines are synchronously scanned by the scan order. K is an integer not less than 2. Each group of lines comprises at least M lines.

17 Claims, 7 Drawing Sheets

SCAN METHOD FOR LIQUID CRYSTAL DISPLAY

BACKGROUND

The invention relates to a scan method for liquid crystal display, and in particular, to a scan method providing specific scan order that optimizes the image.

In flat panel displays, resolution grows higher and higher, as a result, response time becomes a major issue. FIG. 1 shows a conventional pixel driving circuit 100. The pixel driving circuit 100 is divided into an upper part 106 and a lower part 108, each comprising a plurality of lines. A first gate driver 102 and a second gate driver 104 are coupled to the upper part 106 and lower part 108 respectively for control of the lines therein. The scan order as shown by the arrows in the FIG. 1, recursively scans from the top to the bottom of each half part. The first gate driver 102 and second gate driver 104 need only process a half part of the flat panel display, taking half the time than before, therefore the saved time can be used for additional processes.

FIG. 2 is a timing chart of a conventional scan method, showing the driving order of the 1080 lines in the flat panel display. The 1080 lines are divided into an upper part 106 and lower part 108, each comprising 540 lines. The horizontal axis represents display enable signal DE, and each of the signals G1 to G1080 individually drives a corresponding line. When DE=1, the upper part 106 activates signal G1, and the lower part 108 activates signal G541. The lines are sequentially driven until DE=540, and when DE=541, the process returns to signal G1 and G541, thus forming a loop. A total of 1080 lines are scanned every 540 clocks because two lines are scanned per clock.

SUMMARY

An embodiment of the invention provides a scan method for use in a flat panel display comprising K groups of lines, comprising the following steps. First, K sequences $S_1$ to $S_K$ are provided. A scan order is then determined according to the K sequences $S_1$ to $S_K$. Thereafter, the K groups of lines are synchronously scanned by the scan order. K is an integer not less than 2. Each group of lines comprises at least M lines.

The step of providing K sequences $S_1$ to $S_K$ comprises the following steps. First, K shift values $N_1$ to $N_K$ are provided, and the shift values are not greater than M. The sequences $S_1$ to $S_K$ are then determined based on the shift values $N_1$ to $N_K$.

The step of determining the scan order comprises sequentially selecting all the first elements in the sequences $S_1$ to $S_K$, all the second elements in the sequences $S_1$ to $S_K$, and so on until the $M_{th}$ elements of the sequences $S_1$ to $S_K$, form the scan order comprising K*M elements.

The step of providing K shift values comprises determining the shift values according to characteristics of the images displayed. The sequences $S_1$ to $S_K$ are:

$$S_i(x)=(x+N_i)\ (mod\ M),\ i=1 \text{ to } K,\ x=1 \text{ to } M;$$

Where $S_i(x)$ denotes the $x_{th}$ element in sequence $S_i$. The shift value $N_1$ is zero, and the shift values $N_2$ to $N_K$ are determined based on the ratio of M and K.

Another embodiment of the invention provides a timing controller implementing the described scan method, and a pixel driving circuit comprising the timing controller.

BRIEF DESCRIPTION OF THE DRAWINGS

The following detailed description, given by way of example and not intended to limit the invention solely to the embodiments described herein, will best be understood in conjunction with the accompanying drawings, in which.

DETAILED DESCRIPTION OF THE INVENTION

The invention takes advantage of the time saved from the divided scan.

Figure 1:
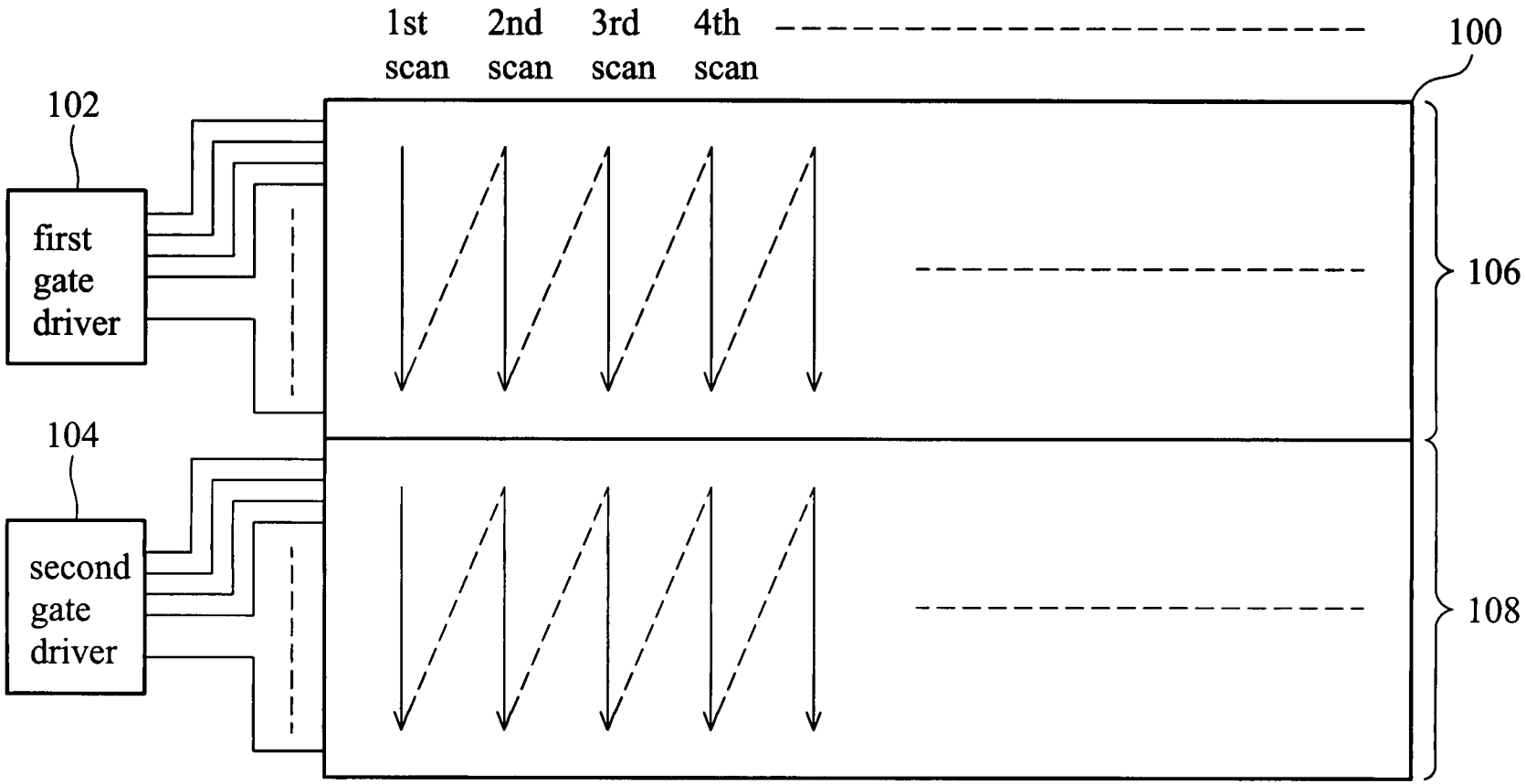
FIG. 1 shows a conventional pixel-driving circuit 100.
Figure 2:
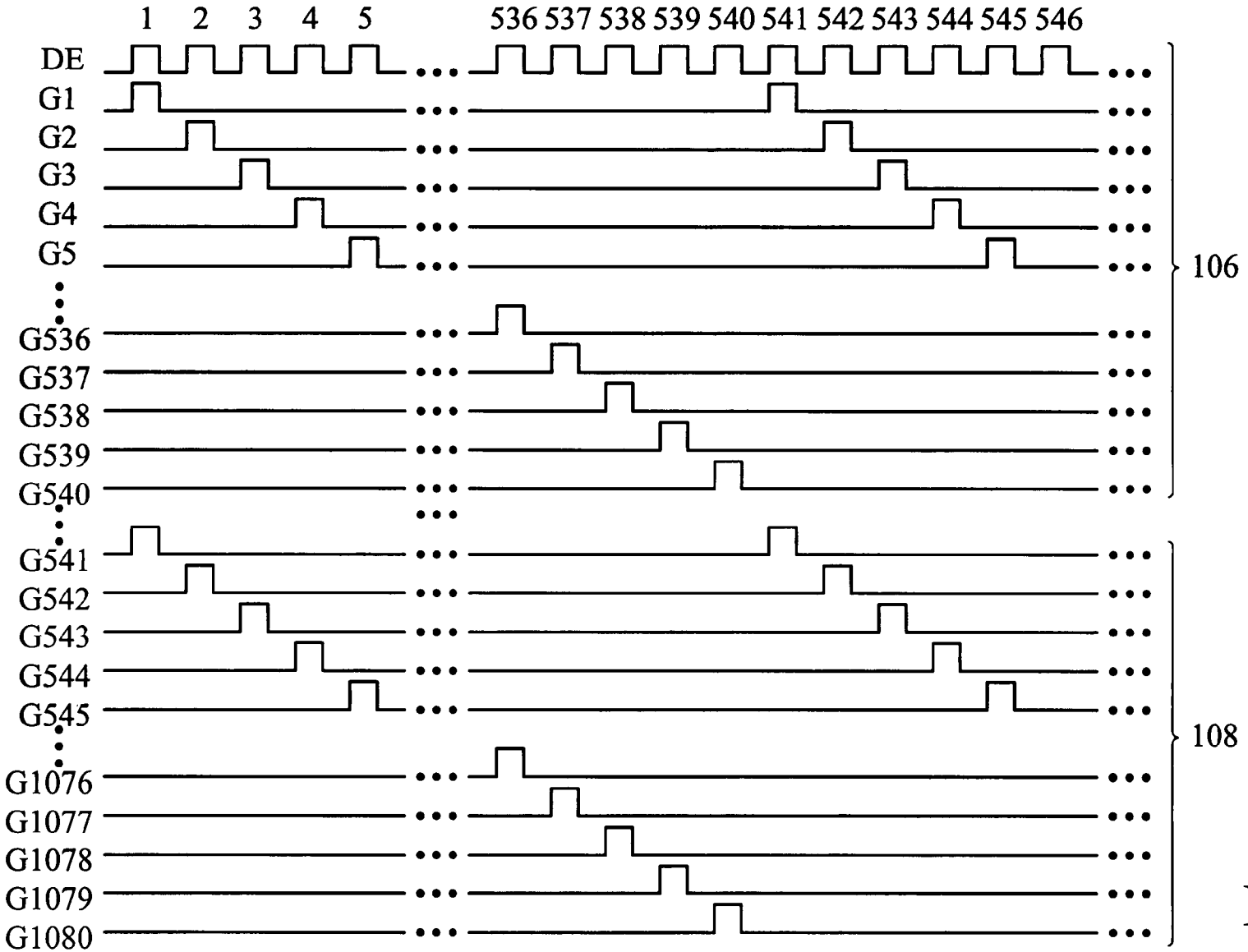
FIG. 2 is a timing chart of conventional scan method.
Figure 3:
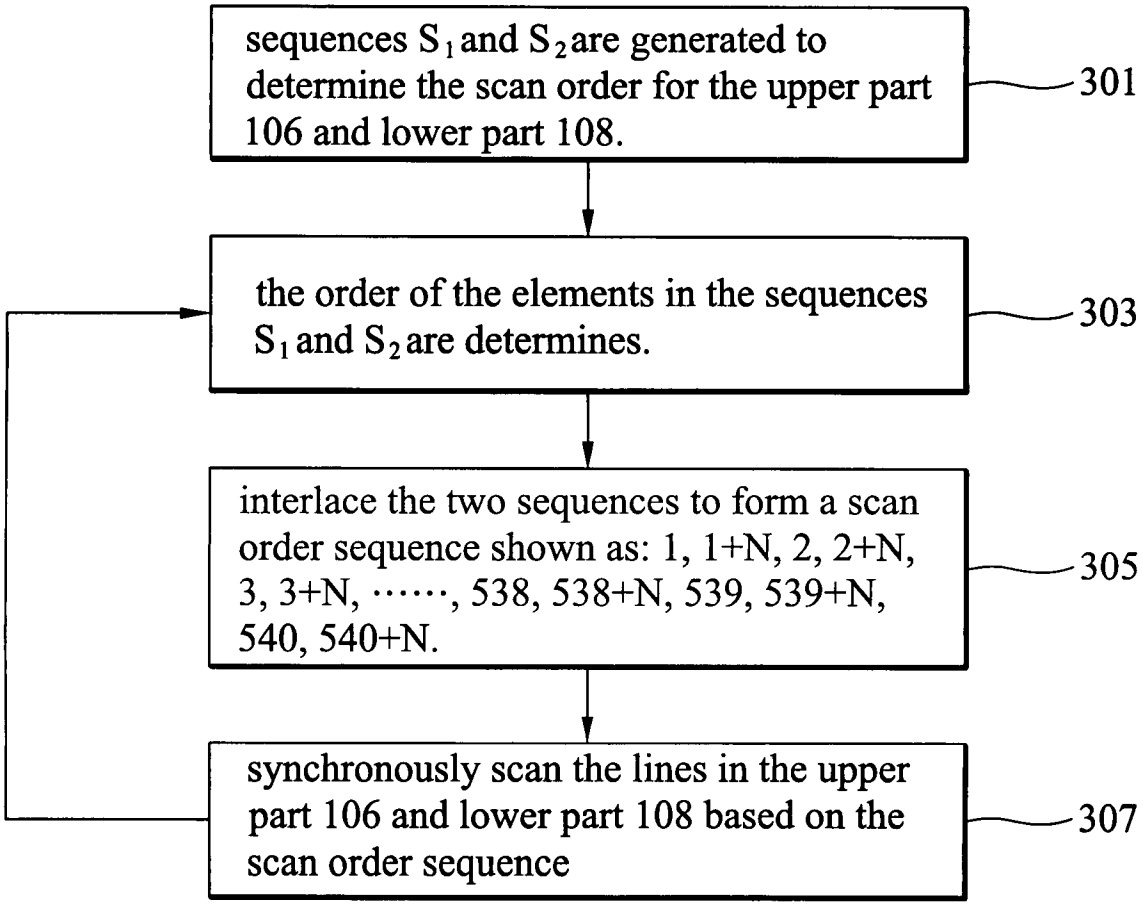
FIG. 3 is a flowchart according to an embodiment of the invention.

FIG. 3 is a flowchart according to an embodiment of the invention. The 1080 lines in a flat panel display are divided into groups, such as upper part 106 and lower part 108 each comprising 540. lines. In step 301, sequences $S_1$ and $S_2$ are performed to determine the scan order for the upper part 106 and lower part 108. The sequences $S_1$ and $S_2$ comprise 540 elements. In step 303, the order of the elements in the sequences $S_1$ and $S_2$ are determined. For example, The sequence $S_1$ is: 1, 2, 3, . . . , 538, 539, 540, which is a natural number sequence. The sequence $S_2$ is: 1+N, 2+N, 3+N . . . , 538+N, 539+N, 540+N, a shifted sequence. The elements in sequence S2 are congruent to 540, and the N is an integer parameter not greater than 540. In step 305, interlacing the two sequences to form a scan order sequence shown as: 1, 1+N, 2, 2+N, 3, 3+N . . . , 538, 538+N, 539, 539+N, 540, 540+N. In step 307, the lines in the upper part 106 and lower part 108 are synchronously scanned based on the scan order sequence, thereby a total of 1080 lines are scanned twice within one time frame, and the N determines the interval of the two scans.

Figure 4A:
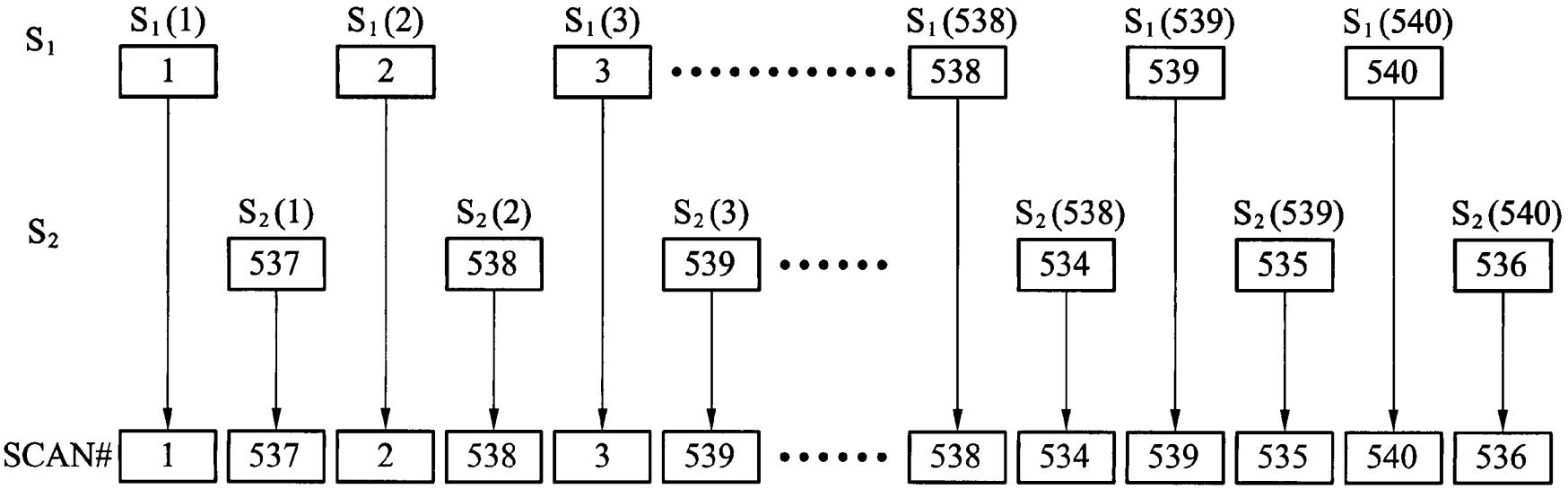
FIG. 4*a* shows an embodiment of the scan sequences.

FIG. 4*a* shows an embodiment of the scan sequences. The liquid crystal display comprises 1080 lines, divided into two parts each comprising 540 lines. The sequence $S_1$ comprises 540 elements, {1, 2, 3, . . . , 540}. The sequence $S_2$ comprises 540 elements, {(N+1)% 540, (N+2)% 540, (N+3)% 540 . . . , (N+540)% 540}, where N is an integer no less than 540, and "%" denotes the congruent operation in order to limit the value between 0 to 540. In the embodiment, N=536, thus $S_2$ is shown as {537, 538, 539, 540, 1, 2, . . . , 536}. Through interlacing the sequences $S_1$ and $S_2$, a scan order SCAN# is obtained, shown as {1, 537, 2, 538, 3, 539, 4, 540, 5, 1, 6, 2, . . . , 540, 536}, comprising a total of 1080 elements. The upper part 106 and lower part 108 thus scan the corresponding lines based on the scan order SCAN#.

In another embodiment, N=270, $S_2$={271, 272, 273, . . . , 510, 1, . . . , 270}. The scan order SCAN# thus becomes {1, 271, 2, 272, 3, 273, 4, 274, 5, 275, . . . , 540, 270}. Further in another embodiment, N=135, $S_2$={136, 137, 138, . . . , 540, 1, . . . , 135}. The scan order SCAN# is then shown as {1, 136, 2, 137, 3, 138, 4, 139, 5, 140, . . . , 540, 135}. The upper part 106 and lower part 108 thus scan the corresponding lines based on the scan order SCAN#.

Figure 4B:
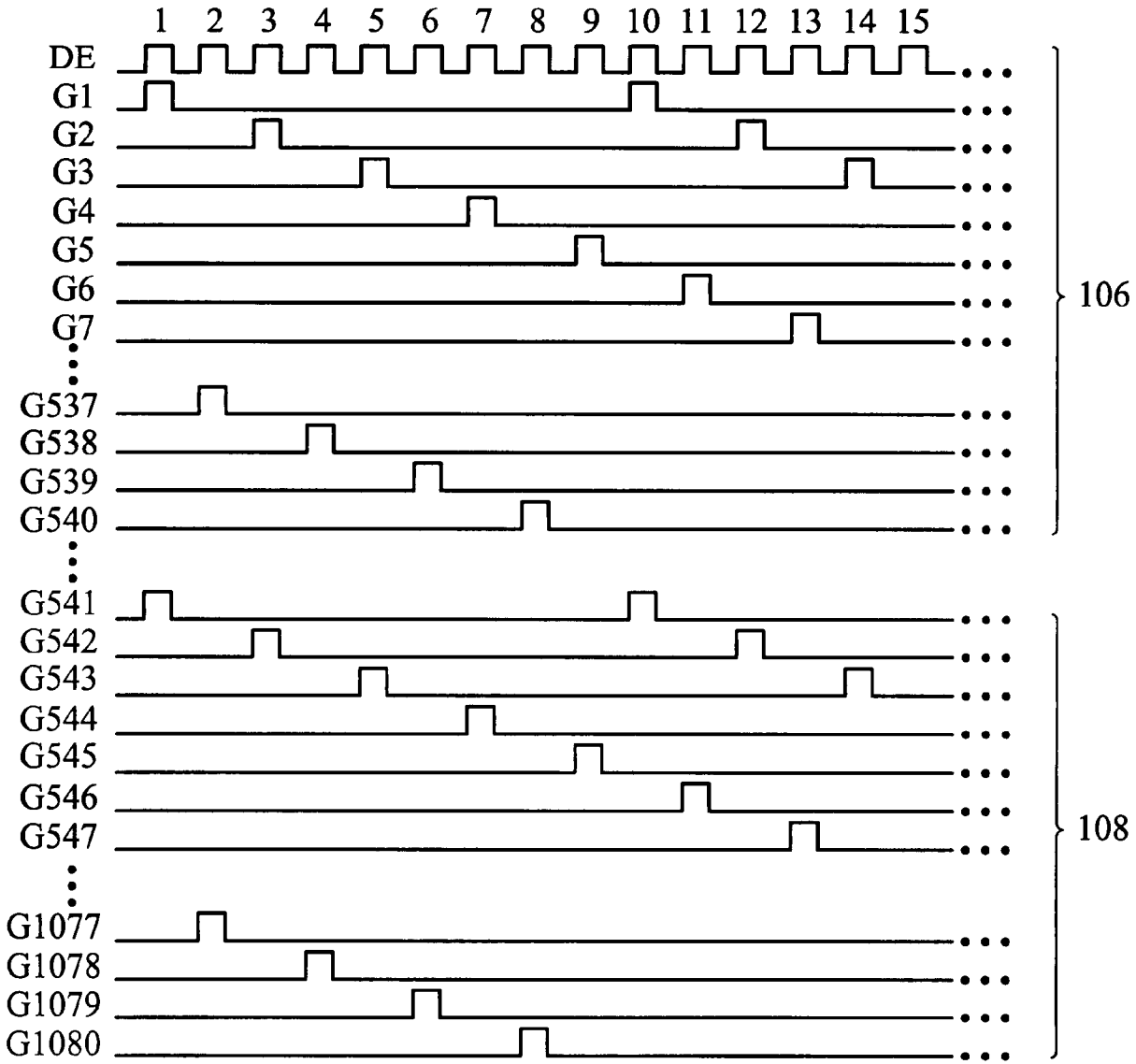
FIG. 4*b* is a timing chart according to FIG. 4*a;*

FIG. 4*b* is a timing chart according to FIG. 4*a*. The scan order SCAN# determines the activating order of the lines in the upper part 106 and lower part 108. For example, when DE=1, the upper part 106 activates signal G1, and the lower part 108 activates the signal G541. When DE=2, the upper part 106 activates signal G537, and the lower part 108 activates the signal G1077. The 1080 lines are not limited to being divided into two groups, and can also be divided into four groups or eight groups. If the 1080 lines are divided into four groups each comprising 270 lines, four sequences $S_1$ to $S_4$ are required to calculate the scan order. In this case, the sequences $S_1$ and $S_2$ may be derived through the described method, and the sequences $S_3$ and $S_4$ can be determined based on the accumulated power consumption of the lines. For each line, four scans are provided, the display can be enhanced by adjusting the scan order. Specifically, an equation can be provided to describe the sequences.

$$S_1(x)=(x+N_i)\ (mod\ M),\ i=1 \text{ to } K,\ x=1 \text{ to } M$$

where $S_i(x)$ denotes the $x_{th}$ element in sequence $S_i$, and (mod M) denotes a congruence residue operation that ensures the Si (x) to be a positive integer not exceeding M. The shift values $N_2$ to $N_K$ may form a non-decreasing function ranging from 1 to M.

Figure 4C:
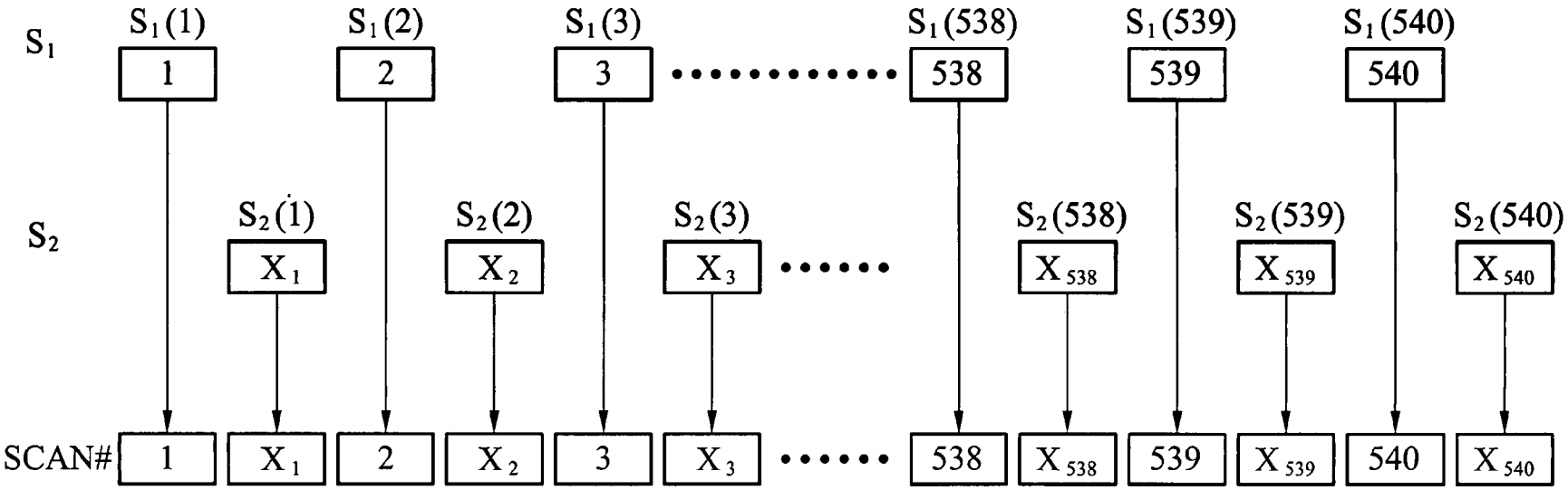
FIG. 4*c* and embodiment of the scan sequences.

FIG. 4*c* shows another embodiment of the scan sequences. Two sequences are provided, in which $S_1=\{1, 2, 3, \ldots, 540\}$, and $S_2$ is defined to be $\{X_1, X_2, X_3, \ldots X_{538}, X_{539}, X_{540}\}$, where $X_1$ to $X_{540}$ can be obtained from a hash function or dependant on characteristics of the image. Any algorithm related to the image can be used to generate the sequence $S_2$, thus the scan order can be flexibly adjusted.

Figure 5:
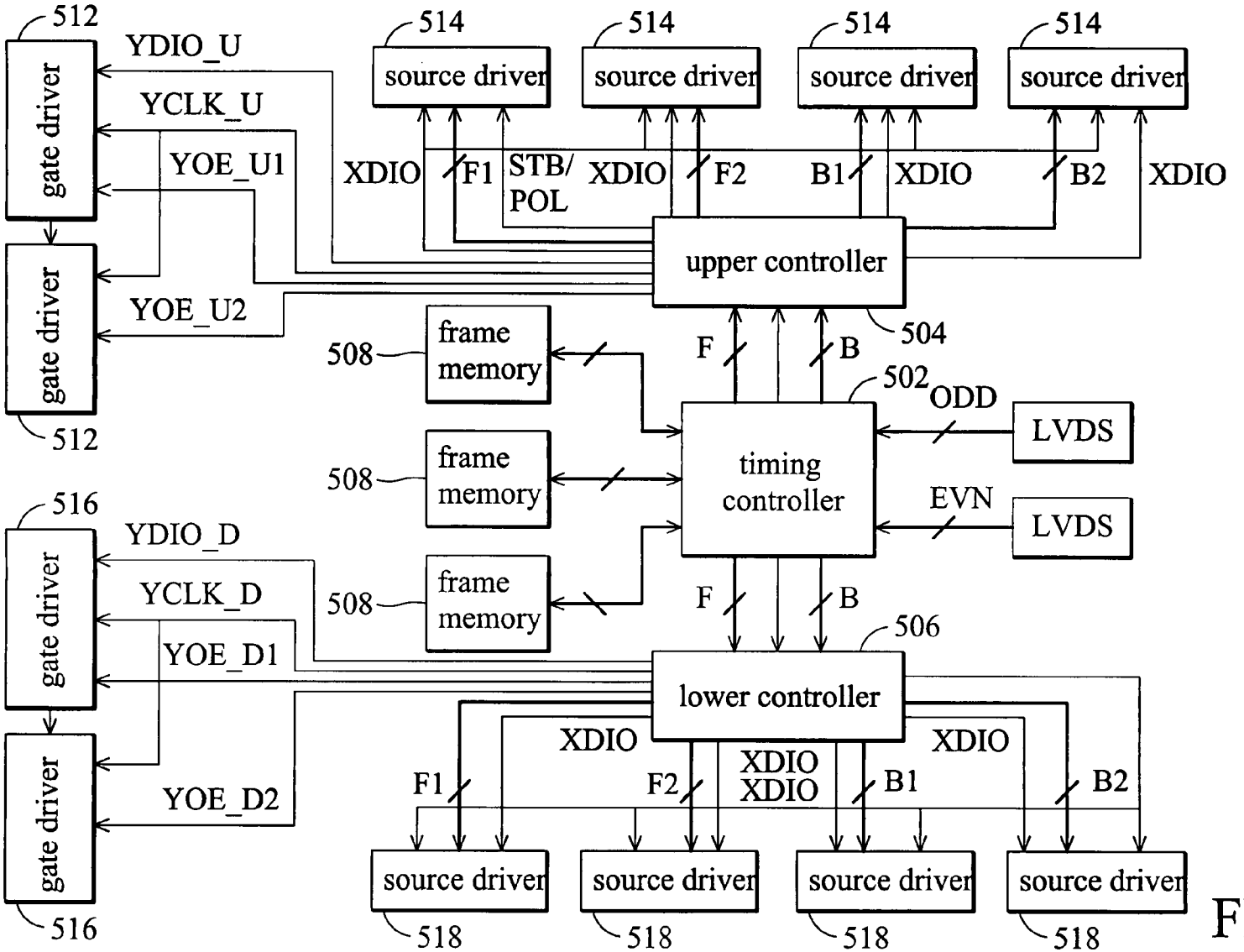
FIG. 5 shows an embodiment of a pixel driving circuit 500.

FIG. 5 shows an embodiment of a pixel driving circuit 500 the pixel driving circuit 500 is divided into upper part 106 and lower part 108, and comprises a timing controller 502 coupled to a upper controller 504 and lower controller 506. The upper controller 504 controls gate drivers 512 and source drivers 514, and the lower controller 506 controls gate drivers 516 and source drivers 518. The pixel driving circuit 500 also comprises a frame memory 508 coupled to the timing controller 502, functioning as a buffer for the timing controller 502 to process images. The timing controller 502 is capable of generating the scan order and driving the upper part 106 and lower part 108 via control of gate drivers 512 and gate drivers 516. Simultaneously, the image data are delivered to source drivers 514 and source drivers 518. In the pixel driving circuit 500, the timing controller 502 cooperates with the frame memory 508 to generate the scan order based on the described method, enhancing display quality and response time.

While the invention has been described by way of example and it terms of the preferred embodiment, it is to be understood that the invention is not limited thereto. To the contrary, it is intended to cover various modifications and similar arrangements (as would be apparent to those skilled in the art) Therefore, the scope of the appended claims should be accorded the broadest interpretation so as to encompass all such modifications and similar arrangements.

What is claimed is:

1. A scan method for a flat panel display comprising Y lines divided into K groups, comprising:

providing K sequences $S_1$ to $S_K$;

determining an interlaced scan order by interlacing the K sequences $S_1$ to $S_K$; and synchronously scanning the K groups of lines based on the interlaced scan order such that each group of lines is scanned K times per Y scan time slots and the each group of lines is scanned alternately, and any two lines in each group of lines are not scanned at the same time in one scan slot; wherein K is an integer not less than 2, wherein:

$$Si(x)=(x+Ni)(mod\ M),\ i=1 \text{ to } K,\ x=1 \text{ to } M;$$

Where Si(x) denotes the xth element in sequence Si.

2. The scan method as claimed in claim 1, wherein:

each group of lines comprises at least M lines;

the step of providing K sequences $S_1$ to $S_K$ comprises:

providing K shift values $N_1$ to $N_K$, wherein the shift values are not greater than M;

determining the sequences $S_1$ to $S_K$ based on the shift values $N_1$ to $N_K$; and the step of determining the interlaced scan order comprises sequentially selecting all the first elements in the sequences $S_1$ to $S_K$, all the second elements in the sequences $S_1$ to $S_K$, and so on until the $M_{th}$ elements of the sequences $S_1$ to $S_K$, to form the interlaced scan order comprising K*M elements.

3. The scan method as claimed in claim 1, wherein at least one of the sequences is determined based on accumulated power consumption of corresponding lines.

4. The scan method as claimed in claim 1, wherein the shift value $N_1$ is zero.

5. The scan method as claimed in claim 4, wherein:

the shift values $N_2$ to $N_K$ form a non-decreasing function ranging from 1 to M.

6. A timing controller, for a liquid crystal display comprising a plurality of lines, wherein:

the timing controller divides Y lines into K groups;

the timing controller provides K sequences $S_1$ to $S_K$ and interlaces the K sequences $S_1$ to $S_K$ to determine an interlaced scan order;

the timing controller synchronously scans the K groups of lines based on the interlaced scan order such that each group of lines is scanned K times per Y scan time slots and the each group of lines is scanned alternately and any two lines in each group of lines are not scanned at the same time in one scan slot;

K is an integer not less than 2, wherein:

$$Si(x)=(x+Ni)(mod\ M),\ i=1 \text{ to } K,\ x=1 \text{ to } M;$$

where Si(x) denotes the xth element in sequence Si.

7. The timing controller as claimed in claim 6, wherein:

each group of lines comprises at least M lines;

the timing controller provides K shift values $N_1$ to $N_K$, wherein the shift values are not greater than M;

the timing controller determines the sequences $S_1$ to $S_K$ based on the shift values $N_1$ to $N_K$; and the timing controller sequentially selects all the first elements in the sequences $S_1$ to $S_K$, all the second elements in the sequences $S_1$ to $S_K$, and so on until the $M_{th}$ elements of the sequences $S_1$ to $S_K$, to form the interlaced scan order comprising K*M elements.

8. The timing controller as claimed in claim 6, wherein the timing controller determines at least one of the sequences based on accumulated power consumption of corresponding lines.

9. The timing controller as claimed in claim 7, wherein:

(mod M) denotes a congruence residue operation that ensures the Si(x) to be a positive integer not exceeding M.

10. The timing controller as claimed in claim 7, wherein the shift value N1 is zero.

11. The timing controller as claimed in claim 10, wherein:

the shift values $N_2$ to $N_K$ form a non-decreasing function ranging from 1 to M.

12. A pixel driving circuit for a flat panel display, synchronously scanning Y lines divided into K groups, comprising:

K gate drivers, each driving a corresponding group of lines;

a timing controller, coupled to the K gate drivers, for controlling a processing order and image data; and a frame memory, coupled to the timing controller, for storing the image data; wherein the timing controller provides K sequences $S_1$ to $S_K$ and interlaces the K sequences $S_1$ to $S_K$ to determine an interlaced scan order;

the timing controller synchronously scans the K groups of lines based on the interlaced scan order via the K gate drivers such that each group of lines is scanned K times per Y scan time slots and the each group of lines is scanned alternately and any two lines in each group of lines are not scanned at the same time in one scan slot; and K is an integer not less than 2, wherein:

$$Si(x)=(x+Ni)(mod\ M),\ i=1 \text{ to } K,\ x=1 \text{ to } M; \text{ and}$$

where Si(x) denotes the xth element in sequence Si.

13. The pixel driving circuit as claimed in claim 12, wherein:

each group of lines comprises at least M lines;

the timing controller provides K shift values $N_1$ to $N_K$, wherein the shift values are not greater than M;

the timing controller determines the sequences $S_1$ to $S_K$ based on the shift values $N_1$ to $N_K$; and the timing controller sequentially selects all the first elements in the sequences $S_1$ to $S_K$, all the second elements in the sequences $S_1$ to $S_K$, and so on until the $M_{th}$ elements of the sequences $S_1$ to $S_K$, to form the interlaced scan order comprising K*M elements.

14. The pixel driving circuit as claimed in claim 12, wherein the timing controller determines at least one of the sequences based on accumulated power consumption of corresponding lines.

15. The pixel driving circuit as claimed in claim 13, wherein:

(mod M) denotes a congruence residue operation that ensures the Si(x) to be a positive integer not exceeding M.

16. The pixel driving circuit as claimed in claim 15, wherein the shift value N1 is zero.

17. The pixel driving circuit as claimed in claim 15, wherein:

the shift values $N_2$ to $N_K$ form a non-decreasing function ranging from 1 to M.

* * * * *